US005992768A

United States Patent [19]

Beatty et al.

[11] Patent Number: 5,992,768

[45] Date of Patent: Nov. 30, 1999

[54] FLUID SEAL FOR CYCLIC HIGH PRESSURES WITHIN A FUEL INJECTOR

[75] Inventors: David J. Beatty; Ralph A. Smith, III, both of Bloomington, Ill.

[73] Assignee: Caterpillar Inc., Peoria, Ill.

[21] Appl. No.: 08/986,919

[22] Filed: Dec. 8, 1997

[51] Int. Cl.[6] ..... F02M 61/00

[52] U.S. Cl. ..... 239/533.9; 239/533.2

[58] Field of Search ..... 239/533.1–533.15, 239/88; 277/645, 650, 909, 910; 123/495, 496, 506, 508

[56] References Cited

U.S. PATENT DOCUMENTS

| | | | |
|---|---|---|---|
| 899,985 | 9/1908 | Huhn . | |
| 2,237,114 | 4/1941 | Read | 251/75 |
| 2,837,360 | 6/1958 | Ladd | 227/910 X |
| 3,149,848 | 9/1964 | Galloway | 277/165 |
| 3,226,126 | 12/1965 | Plate | 277/125 |
| 3,328,041 | 6/1967 | Bloom et al. | 277/909 X |
| 4,123,037 | 10/1978 | Gillespie | 251/367 |
| 4,240,609 | 12/1980 | Hahn et al. | 251/282 |
| 4,374,583 | 2/1983 | Barrington | 251/324 |
| 4,582,330 | 4/1986 | Lew et al. | 277/909 X |
| 4,602,791 | 7/1986 | Zöllner | 227/909 X |
| 4,714,257 | 12/1987 | Heinrich et al. | 277/1 |
| 5,197,807 | 3/1993 | Kuznar | 227/645 X |
| 5,682,861 | 11/1997 | Stockner et al. | 123/495 |
| 5,901,686 | 5/1999 | Stockner et al. | 123/495 |

FOREIGN PATENT DOCUMENTS

| | | | |
|---|---|---|---|
| 0809015A1 | 4/1997 | European Pat. Off. | F02M 59/44 |
| 1 574 128 | 1/1976 | United Kingdom | F02M 57/02 |

*Primary Examiner*—Andres Kashnikow
*Assistant Examiner*—Sean P. O'Hanlon
*Attorney, Agent, or Firm*—Michael B. McNeil

[57] ABSTRACT

A plunger and barrel assembly includes a barrel that defines a plunger bore. A plunger having a pressure face end and a side surface is positioned in the plunger bore and moveable between an advanced position and a retracted position. An O-ring is in contact with the side surface of the plunger and the plunger bore. At least one of the plunger and the barrel define a receiver volume that opens into the plunger bore. A compressible member is positioned in the receiver volume.

20 Claims, 3 Drawing Sheets

FLUID SEAL FOR CYCLIC HIGH PRESSURES WITHIN A FUEL INJECTOR

TECHNICAL FIELD

The present invention relates generally to fluid seals within fuel injectors, and more particularly to a fluid seal for a reciprocating plunger exposed to relatively high cyclic fluid pressures over each injection cycle.

BACKGROUND ART

In one class of fuel injectors, a reciprocating plunger is utilized to pressurize fuel to initiate and sustain injection. With each reciprocation, pressure gradients along the plunger can oscillate between zero and about twenty thousand psi or more at a frequency of many times per second. Because of this high cyclic pressure gradient, fuel naturally has the tendency to leak past the plunger along the plunger bore wall. For a number of reasons, including decreased complexity, increased reliability, allowable fuel leakage, concerns about where and how to route the leaked fuel and for other reasons known to those skilled in the art, it is often desirable to eliminate leakage past the plunger by using an O-ring seal. However, because of the high frequencies involved in injection cycles and the extreme magnitude of cyclic pressure changes acting on an O-ring seal, most presently available O-rings tend to fail long before the other components of the fuel injector. In other words, O-ring technology has not sufficiently advanced to provide reliable and long term sealing at the high frequencies and relatively extreme pressures experienced within a fuel injector environment.

One response to this problem has been to include a pressure receiver volume at a position between the O-ring and the pressure face end of the plunger. This pressure receiver volume typically takes the form of an annulus machined in the side wall of the plunger below the O-ring but above the pressure face end of the plunger. Cyclic pressures on the O-ring are substantially attenuated by the inclusion of a pressure receiver volume since a substantial amount of the high pressure in each injection cycle is absorbed in the receiver volume before the same ever reaches the O-ring seal. Pressure in the receiver volume drops or resets itself when the plunger is undergoing its return stroke between injection events. One problem associated with the simple use of a receiver volume to attenuate pressures on the O-ring is the need to make the volume relatively large in order to provide a satisfactory attenuation on the pressures experienced by the O-ring seal. In other words, more pressure attenuation can be provided by making the receiver of volume ever larger; however, realistic space constraints and plunger guiding considerations, among other things, limit the realistic amount of volume that can be devoted to the pressure receiver volume space.

The present invention is directed to overcoming this and other problems associated with sealing against fluid leakage past a reciprocating plunger within a fuel injector.

DISCLOSURE OF THE INVENTION

A plunger and barrel assembly includes a barrel that defines a plunger bore. A plunger having a pressure face end and a side surface is positioned in the plunger bore and moveable between an advanced position and a retracted position. An O-ring is in contact with the side surface of the plunger and the plunger bore. At least one of the plunger and the barrel define a receiver volume that opens into the plunger bore. A compressible member is positioned in the receiver volume.

In another embodiment, a plunger and barrel assembly includes a barrel that defines a plunger bore. A plunger having a pressure face end and a side surface is positioned in the plunger bore and moveable between an advanced position and a retracted position. An O-ring is in contact with the side surface of the plunger and the plunger bore. At least one of the plunger and barrel define a receiver volume that opens into the plunger bore between the pressure face end of the plunger and the O-ring. A compressible member that defines a trapped volume filled with a gas is positioned in the receiver volume.

In still another embodiment, a fuel injector includes an injector body that defines a plunger bore and a nozzle outlet. A plunger having a pressure face end and the side surface is positioned in the plunger bore and moveable between an advanced position and a retracted position. A portion of the plunger and the plunger bore define a fuel pressurization chamber in fluid communication with the nozzle outlet. A needle valve member is positioned in the injector body and moveable between an open position in which the nozzle outlet is open, and a closed position in which the nozzle outlet is blocked. An O-ring is in contact with the side surface of the plunger and the plunger bore. At least one of the plunger and the barrel define a receiver volume that opens into the plunger bore between the pressure face end of the plunger and the O-ring. A compressible member that defines a trapped volume filled with a gas is positioned in the receiver volume.

BEST MODE FOR CARRYING OUT THE INVENTION

Figure 1:
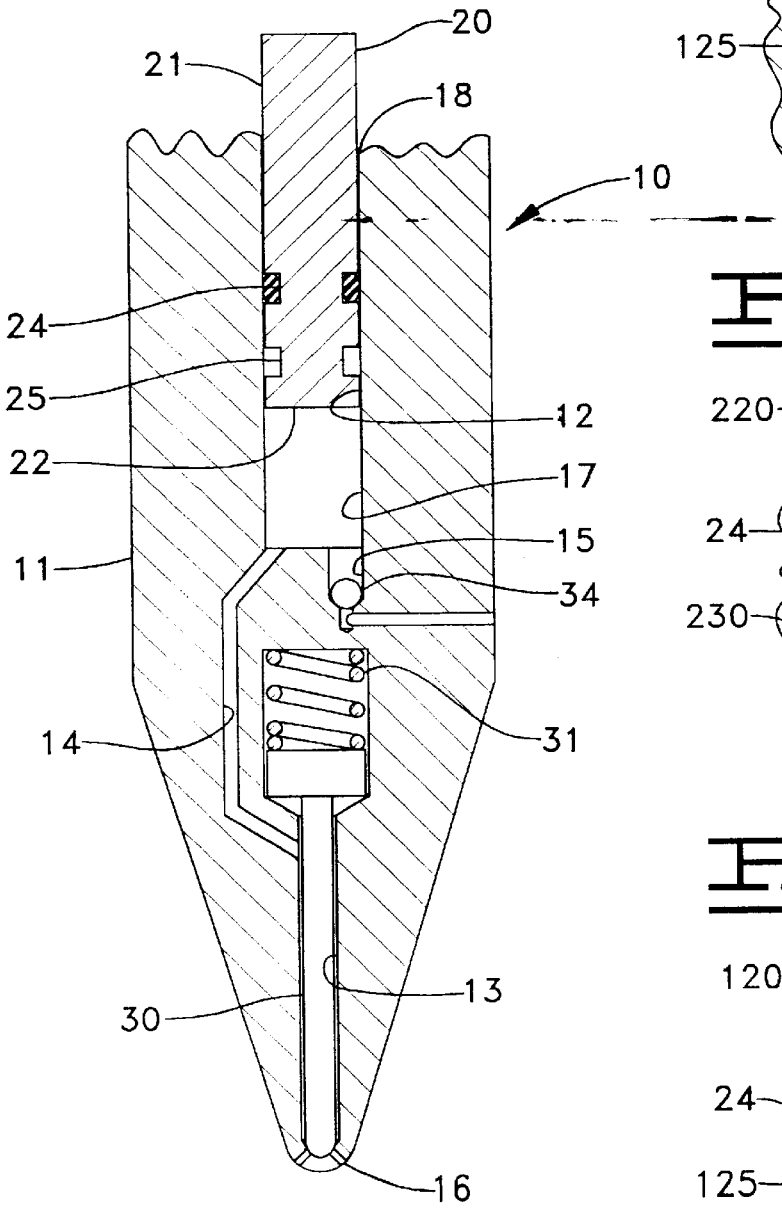
Fig 1 (PRIOR ART)
FIG. 1 is a partial sectioned side elevational view of a fuel injector according to the prior art.

Referring now to FIG. 1, a prior art fuel injector 10 of the type that utilizes a plunger to pressurize fuel is illustrated for the purposes of explaining the problems solved by the present invention. Injector 10 includes an injector body 11 that defines a plunger bore 12 which opens to a nozzle outlet 16 via a nozzle supply passage 14 and a nozzle chamber 13. A plunger 20 has a pressure face end 22 and a side surface 21. Plunger 20 is positioned in plunger bore 12 and moveable between an advanced position and a retracted position, as shown. A portion of plunger bore 12 and plunger 20 define a fuel pressurization chamber 17 that opens to nozzle supply bore 14. A fuel supply passage 15 re-supplies fuel to fuel pressurization chamber 17 when plunger 20 is retracting toward its retracted position. A check valve 34 prevents the back flow of fuel from fuel pressurization chamber 17 into fuel supply passage 15 when plunger 20 is undergoing its downward pumping stroke.

A needle valve member 30 is mounted within nozzle chamber 13 of injector body 11. Needle valve member 30 is capable of moving to an open position in which nozzle chamber 13, and hence fuel pressurization chamber 17, are open to nozzle outlet 16. Needle valve member 30 is normally biased via compression spring 31 to a closed position, as shown, in which nozzle chamber 13 is blocked to nozzle outlet 16. When plunger 20 begins its downward stroke, pressure within fuel pressurization chamber 17 quickly rises. This fuel pressure in turn acts upon hydraulic lift surfaces on needle valve member 30 causing it to lift to its open position against the action of compression spring 31. Each injection event ends when fuel pressure within fuel pressurization chamber 17 drops below that which is necessary to hold needle valve member 30 open. Those skilled in the art will appreciate that this end of the injection event can be caused by a number of factors including ceasing the downward movement of plunger 20, providing a spill port, or by some other suitable means known in the art. Those skilled in the art will also appreciate that other known types of needle valve members other than the valve opening pressure type illustrated could be utilized in a fuel injector according to the present invention.

Figure 7:
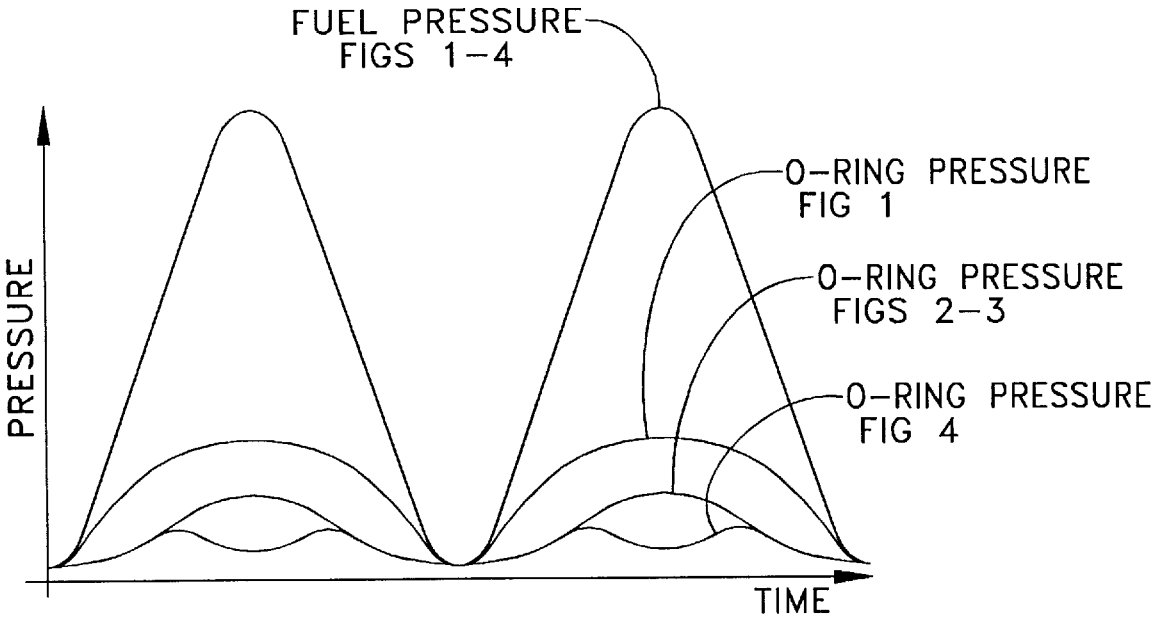
FIG. 7 is a graph of pressure versus time for two injection cycles at certain locations within the fuel injectors of FIGS. 1–4.

FIG. 7 shows an example pressure trace within fuel pressurization chamber 17 for two reciprocation cycles of plunger 20 (i.e. two injection cycles of the injector). The peak pressure can be in excess of twenty thousand psi. In order to prevent leakage in the annular area 18 that exists between the side surface 21 of plunger 20 and the wall of plunger bore 12, an O-ring 24 is included within an annular indentation that is machined into plunger 20. O-ring 24 acts as the seal against fuel pushed along plunger 20 during the extreme pressures that occur during the injection event. While there are available O-rings that can provide an adequate seal at these extreme pressures, none have shown themselves sufficiently robust to satisfactorily perform over the millions of rapid cycles that are undergone in the life of a typical fuel injector of this type. In order to attenuate the pressure on O-ring 24, a receiver volume 25 opens into plunger bore 12 and is positioned between pressure face end 22 and O-ring 24. Receiver volume 25 in this example takes the form of an annulus machined inside surface 21 of plunger 20. As can be seen from FIG. 7, the inclusion of receiver volume 25 substantially reduces the fuel pressure against which O-ring 25 must seal. However, there remains room for improvement.

Figure 2:
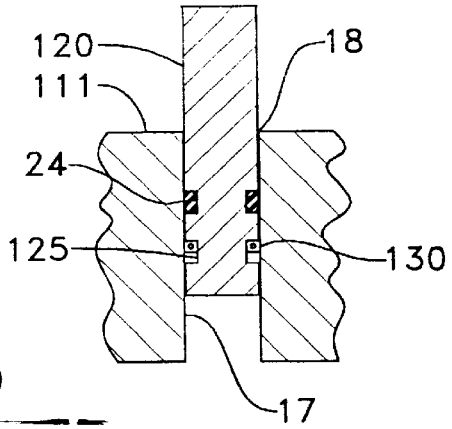
FIG. 2 is a partial sectioned side elevational view of a portion of a fuel injector according to one embodiment of the present invention.
Figure 3:
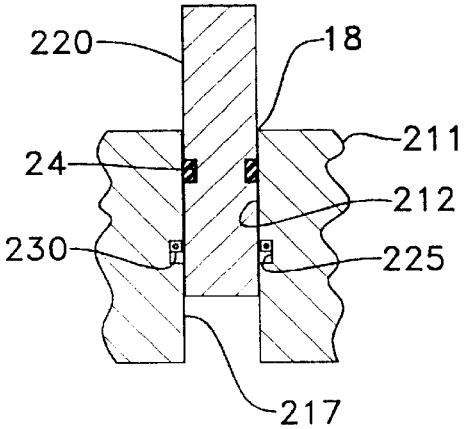
FIG. 3 is a partial sectioned side elevational view of a portion of a fuel injector according to another embodiment of the present invention.
Figure 4:
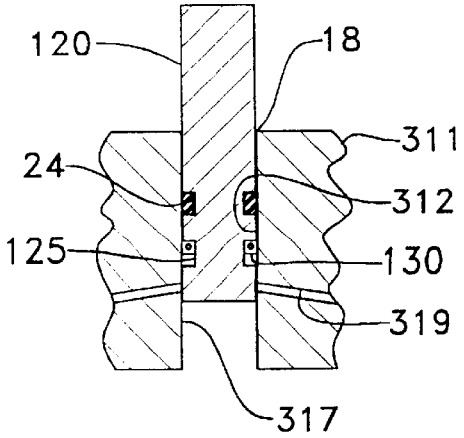
FIG. 4 is a partial sectioned side elevational view of a portion of a fuel injector according to still another embodiment of the present invention.
Figure 5:
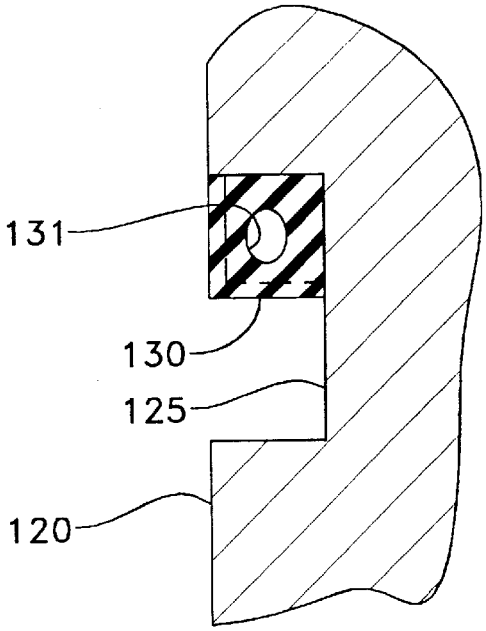
FIG. 5 is an enlarged sectional view of a receiver volume and compressible member according to one aspect of the present invention.

Referring now in addition to FIGS. 2–4, the present invention seeks to further attenuate the extreme pressures that could otherwise act on the O-ring seal in order to increase the working life of the O-ring while maintaining a fuel tight seal past the plunger. In particular, FIG. 2 shows an injector body 111 that is substantially identical to that of the prior art in that it includes a fuel pressurization chamber 17 and an annular gap 18 where leakage could occur. In this embodiment, plunger 120 of the present invention includes an O-ring seal that is substantially identical to that of the prior art. As a means for further attenuating pressure on O-ring 24, a pressure receiver volume 125, in the form of an annulus machined on plunger 120, is included. A ring shaped compressible member 130 is positioned in receiver volume 125. Compressible member 130 preferably has a square or rectangular shape and includes a trapped volume of compressed gas 131 within its interior (see FIG. 5). During the cyclic high pressures, the rise in pressure within receiver volume 125 compresses the compressible member 130 and at least partially collapses the trapped volume of gas 131. FIG. 5 shows with dashed lines that when compressed, compressible member 130 occupies a relatively small volume. As evident from the illustration, when compressible member 130 is uncompressed, it returns to its original shape, occupying a relatively large volume. FIG. 7 shows that by including compressible member 130 in receiver volume 125, the pressure seen by O-ring 24 is further attenuated over that of the prior art.

FIG. 3 shows another embodiment of the present invention in which a receiver volume 225 is machined in plunger bore 212 of injector body 211, rather than on the side surface of the plunger as in the previous embodiment. In this embodiment, a plunger 220 includes an O-ring 24 in contact between plunger bore 212 and the side surface of the plunger. This embodiment is identical to the previous embodiments in that a portion of plunger 220 and plunger bore 212 define a fuel pressurization chamber 217. A compressible member 230 in the form of a ring is positioned in receiver volume 225. As seen in FIG. 7, this embodiment works substantially identical to that of FIG. 2, but is believed to be more difficult to manufacture since it is generally more difficult to machine an annulus on the inside of a plunger bore than it is to machine an annulus on the outer surface of a plunger. Like the previous embodiment, receiver volume 225 remains positioned between O-ring 24 and the pressure face end of plunger 220 over the complete stroke between its retracted and advanced positions.

Referring now to FIG. 4, still another embodiment of the present invention is illustrated in which a plunger 120 is positioned in a plunger bore 312 defined by an injector body 311. As with the previous embodiments, a sealing O-ring 24 is mounted on plunger 120, and a fuel pressurization chamber 317 is defined by a portion of plunger 120 and plunger bore 312. Like the embodiment shown in FIG. 2, plunger 120 includes a receiver volume annulus 125 within which is positioned a compressible ring 130.

This embodiment differs in that it includes a pair of pressure relief passages 319 that open into plunger bore 312 between the pressure face end of plunger 120 and the receiver volume 125. Referring in addition to FIG. 7, as plunger 120 moves downward, pressure builds within receiver volume 125 and compressible member 130 is compressed. This pressure rise is relieved as receiver volume 125 passes pressure relief passages 319. Thus, this embodiment provides a further attenuation of pressure on O-ring 24 than that of the embodiments shown in FIGS. 2 and 3. This is accomplished since the pressure within receiver volume 125 is relieved while plunger 120 is undergoing its downward pumping stroke. Since the O-ring must seal against lower pressures in all of the embodiments shown, its working life will naturally be extended.

Figure 6:
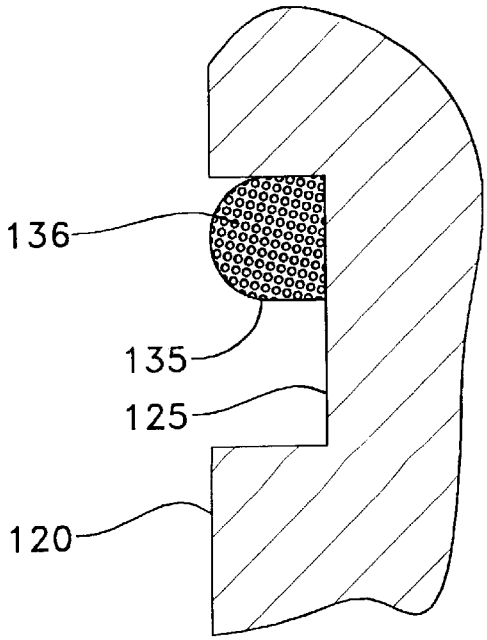
FIG. 6 is an enlarged sectional view of a receiver volume and compressible member according to another aspect of the present invention.

Referring now to FIGS. 5 and 6, the compressible member according to the present invention can come in a variety of shapes and be made from a variety of materials without departing from the intended scope of the present invention. For instance, the embodiment shown in FIG. 5 shows the accumulator having a square cross section with an amount of gas trapped in a hollow interior 131. The embodiment of FIG. 6 shows a D shape with a large number of small trapped gas bubbles. Also, the outer surface of compressible member 130 can have a variety of different cross sectional shapes including circles, etc. The compressible member 130 should be made from a suitable resilient material that has the ability of being compressed to partially collapse the inner trapped gas, but quickly recovers its original shape when the external pressure is removed. It should be pointed out that compressible member 130 can lie completely within receiver volume 125 and not come in contact with the plunger bore wall. The member's function is not to provide any sealing but instead is to expand and compress with each plunger cycle. This is especially important for embodiments of the invention like that of FIG. 4 where the receiver volume must necessarily pass a passageway 319. Excessive wear on the outer surface of the compressible member can undermine its performance and possibly eventually lead to a release of the trapped gas within its interior, which would prevent it from performing as desired.

FIG. 6 shows an alternative embodiment of the present invention in which compressible member 135 has a D-shape and contains a plurality of trapped bubbles 136 instead of the single annular ring of trapped gas 131 as in FIG. 5. The embodiment of FIG. 6 would require that the statistical distribution of bubbles be known to a degree of certainty such that the amount of trapped gas within the compressible member 135 could be predicted and known to a desired degree of accuracy.

Figure 8:
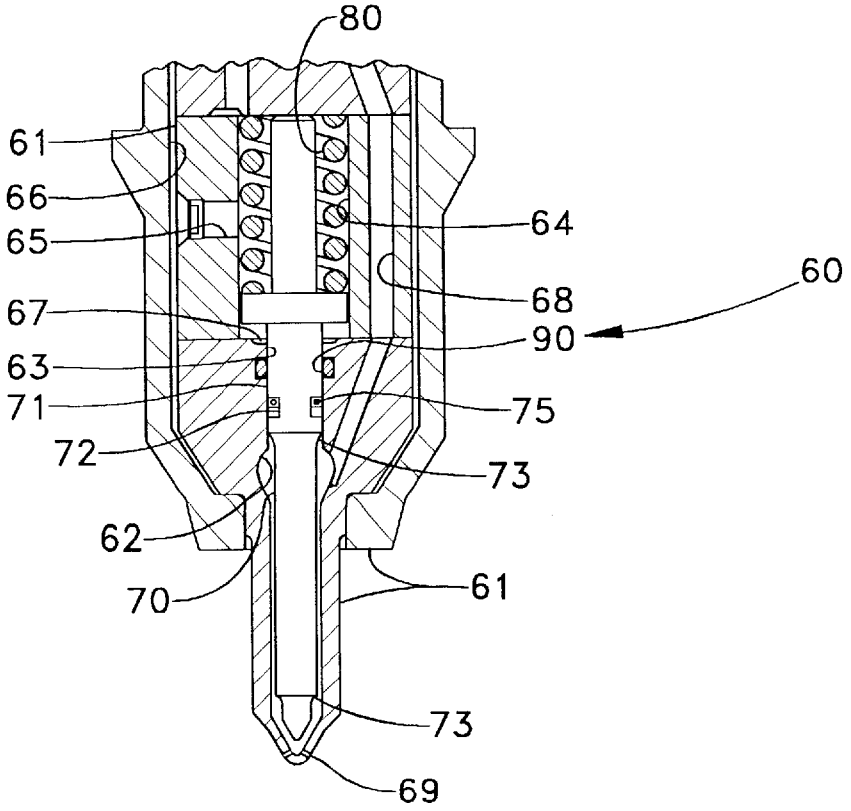
FIG. 8 is a partial sectioned side elevational view of the fuel injector according to another embodiment of the present invention.

Although the fluid sealing strategy of the present invention was originally contemplated for use in regard to sealing against leakage in a plunger, the present invention finds potential application in other locations within a fuel injector. One of these potential applications is illustrated in FIG. 8 which shows the fluid sealing strategy of the present invention being applied to prevent leakage past the needle valve member of a fuel injector. In particular, a fuel injector 60 includes an injector body 61 made up of various components that are held together in a manner well known in the art. The injector body defines a nozzle chamber 62 connected to a low pressure spring cage 64 via a bore 63. A cylindrically shaped needle valve member 71 is positioned to reciprocate within bore 63 between an open position in which nozzle outlet 69 is opened to nozzle chamber 62, and a closed position in which nozzle outlet 69 is blocked. During each injection cycle, high pressure fuel acts upon hydraulic lift surfaces 73 of needle valve member 71 to move the same against the action of return spring 80 to its opened position. When pressure within nozzle chamber 62 drops sufficiently, needle valve member 71 closes under the action of return spring 80 in a manner known in the art.

In the case of the present invention, nozzle chamber 62 can be thought of as a cyclic high pressure space since it experiences an extremely high peak fuel pressure during each injection cycle but returns to a relatively low pressure between each injection event. Pressure within spring cage 64 is normally maintained at a relatively low pressure via an opening 65 that connects to low pressure fuel supply return area 66. During injection events, the high pressure in nozzle chamber 62 tends to cause leakage in prior art devices between bore 63 and the side surface 71 of needle check 70. In this embodiment of the invention, leakage is prevented at location 67 due to the inclusion of a stationary O-ring 90 and an annular pressure receiver volume 72 machined in the side surface 71 of needle valve member 70. A ring shaped compression member 75 is positioned in receiver volume 72, in a manner similar to that of the embodiments shown in FIGS. 2 and 4.

O-ring 90 sees only a fraction of the pressure experienced within nozzle chamber 62 due to the fact that pressure on the O-ring is attenuated by being absorbed by the compression of compression member 75 and built-up within receiver volume 72, rather than acting directly upon the O-ring. Thus, this strategy allows spring cage 64 to be sealed against leakage along needle valve member 70 with an O-ring rated for pressures far lower than that encountered in nozzle chamber 62.

INDUSTRIAL APPLICABILITY

Although the present invention finds preferred application in sealing against leakage along the plunger of a fuel injector, the present invention can find potential application in different plunger and barrel assemblies used in different applications. In other words, the sealing strategies of the present invention can be employed in virtually any plunger and barrel assembly in which the plunger reciprocates in a bore and is subjected to cyclic high pressures. Accordingly, the term plunger, as used in this description, refers to any cylindrically shaped member, including the needle valve member 70 of FIG. 8, that reciprocates in a bore that is defined by a barrel or body.

In general, three different variables are available to optimize the pressure attenuation properties of the present invention for a given application. These variables include the volume of gas trapped within the compression member, the volume occupied by the compression member when in its expanded shape, and the volume of the pressure receiver annulus. Because the compression member is partially hollow in that it includes trapped gas, its over all bulk modulus is much lower than that of fuel. Therefore, as the fuel enters the receiver volume, the compression member compresses without a significant rise in pressure. While the compression member compresses, the pressure rise rate that the O-ring is subjected to is significantly retarded. The compression member is preferably sized in its expanded shape such that it only becomes fully compressed when the injection process is complete. Between injection events, the compression member resiliently resumes its original shape as the system pressure decays.

The above description is intended for illustrative purposes only, and is not intended to limit the scope of the present invention in any way. Those skilled in the art will appreciate that the sealing strategies disclosed above could find potential application in a wide variety of plunger and barrel assemblies, including some that have no relationship whatsoever to fuel injectors. Furthermore, those skilled in the art will appreciate that various modifications and other changes can be made to the present invention without departing from the spirit and scope of the invention. For instance, while the receiver volumes have been preferably described as annuluses, virtually any shaped volume that is properly positioned could be utilized to accomplish the goals of the present invention. The scope of the present invention should be broadly interpreted based upon the claims as set forth below.

We claim:

1. A plunger and barrel assembly comprising:

a barrel defining a plunger bore;

a plunger having a pressure face end and a side surface, and being positioned in said plunger bore and movable between an advanced position and a retracted position;

an O-ring in contact with said side surface of said plunger and said plunger bore;

at least one of said plunger and said barrel defining a receiver volume that opens into said plunger bore; and a compressible member positioned in said receiver volume.

2. The plunger and barrel assembly of claim 1 wherein said receiver volume opens into said plunger bore between said O-ring and said pressure face end.

3. The plunger and barrel assembly of claim 1 wherein said compressible member defines a trapped volume filled with a gas.

4. The plunger and barrel assembly of claim 1 wherein said compressible member includes a resilient body that occupies a relatively large volume when uncompressed and a relatively small volume when compressed.

5. The plunger and barrel assembly of claim 1 wherein said receiver volume is an annulus formed in said side surface of said plunger.

6. The plunger and barrel assembly of claim 1 wherein said compressible member occupies a first volume when uncompressed and a second volume when compressed; and said receiver volume is larger than said first volume, and said first volume is larger than said second volume.

7. The plunger and barrel assembly of claim 1 wherein said compressible member is ring shaped with a rectangular cross section.

8. The plunger and barrel assembly of claim 1 wherein said barrel defines a pressure relief passage that opens to said plunger bore between said pressure face end and said O-ring.

9. A plunger and barrel assembly comprising:

a barrel defining a plunger bore;

a plunger having a pressure face end and a side surface, and being positioned in said plunger bore and movable between an advanced position and a retracted position;

an O-ring in contact with said side surface of said plunger and said plunger bore;

at least one of said plunger and said barrel defining a receiver volume that opens into said plunger bore between said pressure face end and said O-ring; and a compressible member defining a trapped volume filled with a gas and being positioned in said receiver volume.

10. The plunger and barrel assembly of claim 9 wherein said compressible member includes a resilient body that occupies a relatively large volume when uncompressed and a relatively small volume when compressed.

11. The plunger and barrel assembly of claim 10 wherein said receiver volume is an annulus formed in said side surface of said plunger.

12. The plunger and barrel assembly of claim 11 wherein said receiver volume is larger than said relatively large volume.

13. The plunger and barrel assembly of claim 12 wherein said compressible member is ring shaped with a rectangular cross section.

14. The plunger and barrel assembly of claim 13 wherein said O-ring is mounted on said plunger.

15. The plunger and barrel assembly of claim 14 wherein said barrel defines a pressure relief passage that opens to said plunger bore between said pressure face end and said O-ring.

16. A fuel injector comprising:

an injector body defining a plunger bore and a nozzle outlet;

a plunger having a pressure face end and a side surface, and being positioned in said plunger bore and movable between an advanced position and a retracted position;

a portion of said plunger and said plunger bore defining a fuel pressurization chamber in fluid communication with said nozzle outlet;

a needle valve member positioned in said injector body and being movable between an open position in which said nozzle outlet is open and a closed position in which said nozzle outlet is blocked;

an O-ring in contact with said side surface of said plunger and said plunger bore;

at least one of said plunger and said injector body defining a receiver volume that opens into said plunger bore between said pressure face end and said O-ring; and a compressible member defining a trapped volume filled with a gas and being positioned in said receiver volume.

17. The fuel injector of claim 16 wherein said compressible member includes a resilient body that occupies a relatively large volume when uncompressed and a relatively small volume when compressed.

18. The fuel injector of claim 17 wherein said receiver volume is an annulus formed in said side surface of said plunger; and said O-ring is mounted on said plunger.

19. The fuel injector of claim 18 wherein said receiver volume is larger than said relatively large volume.

20. The fuel injector of claim 19 wherein said compressible member is ring shaped with a rectangular cross section.

* * * * *